US008205961B2

(12) United States Patent
Kubo

(10) Patent No.: US 8,205,961 B2
(45) Date of Patent: Jun. 26, 2012

(54) INKJET RECORDING APPARATUS

(75) Inventor: Isamu Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 915 days.

(21) Appl. No.: 11/894,858

(22) Filed: Aug. 21, 2007

(65) Prior Publication Data

US 2008/0218564 A1 Sep. 11, 2008

(30) Foreign Application Priority Data

Aug. 28, 2006 (JP) ..... 2006-229971

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS

| | | | | |
|---|---|---|---|---|
| 4,930,897 | A * | 6/1990 | Herfeld et al. | 366/98 |
| 5,840,106 | A * | 11/1998 | Krepski et al. | 106/506 |
| 2006/0061620 | A1* | 3/2006 | Tani et al. | 347/36 |
| 2006/0214981 | A1* | 9/2006 | Fukasawa et al. | 347/29 |

FOREIGN PATENT DOCUMENTS

| | | |
|---|---|---|
| JP | 2979997 | 9/1999 |
| JP | 2001-293887 | 10/2001 |
| JP | 2002-192751 | 7/2002 |
| JP | 2002-225313 | 8/2002 |
| JP | 2004-284360 | 10/2004 |
| JP | 2005-35074 | 2/2005 |
| JP | 2005-144940 | 6/2005 |
| JP | 2006-31006 | 2/2006 |
| JP | 2006-82526 | 3/2006 |

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An inkjet recording apparatus that records an image by discharging ink from an inkjet recording head is disclosed. The inkjet recording apparatus includes a disposal liquid tank that accommodates disposal ink that is discharged from the inkjet recording head for purposes other than recording, a mixing member that mixes the disposal ink accumulated in the disposal liquid tank, and a cleaning unit that cleans the mixing member.

16 Claims, 12 Drawing Sheets

INKJET RECORDING APPARATUS

BACKGROUND

1. Technical Field

This disclosure relates to an inkjet recording apparatus that is capable of preventing accumulation of disposal ink discharged for purposes other than recording.

2. Description of the Related Art

In an inkjet recording apparatus that records an image on a recording medium (e.g., paper) by discharging ink from a recording head, printing malfunction may occur when the apparatus is not used for a long time and the ink solidifies to clog up the ink nozzle of the recording head or when foreign particles or air bubbles clog up the ink nozzle, for example. Thus, when printing is not performed for a long time or when foreign particles or air bubbles clog up the ink nozzle, the inkjet recording apparatus is configured to perform idle discharge operations for discharging ink out of the ink nozzle and forcing the solidified ink, foreign particles, or air bubbles out of the ink nozzle together with the discharged ink to thereby clean and restore the ink nozzle.

FIGS. 1A and 1B are cross-sectional views of a maintenance/restoration device of an inkjet recording apparatus. The illustrated maintenance/restoration device includes a suction cap 202 for sealing the ink nozzle surface of an inkjet recording head 201, a tube 203 that is connected to the suction cap 202, a suction pump 204 that attracts the viscous ink, foreign particles, or air bubbles clogging the ink nozzle through the tube 203 with suction force, and a disposal liquid tank 205 that collects disposal liquid that is pumped out by the suction pump 205. When the disposal liquid is in liquid state, the disposal liquid may be evenly distributed within the disposal liquid tank 205 as is shown in FIG. 1A. However, when viscous ink or solidified ink is accumulated within the disposal liquid tank, the accumulated ink may not be evenly distributed and may be heaped up to block the disposal outlet of the tube 203 and hinder further disposal of liquid discharged from the recording head 201 even when the disposal liquid tank 205 is not full as is shown in FIG. 1B. In turn, the disposal liquid collected in the disposal liquid tank 205 may have to be frequently discarded so that operationality of the inkjet recording apparatus may be degraded, for example. It is noted that such a problem may be particularly prominent when ink with high viscosity such as pigment ink is used in a low humidity environment since such ink may be easily dried up. In turn, various techniques have been proposed for solving such a problem.

For example, Japanese Laid-Open Patent Publication No. 2001-293887 (D1) discloses arranging a rotating member for receiving disposal liquid discharged for purposes other than recording, securing some space at the upper side of the rotating member, and scraping off accumulated ink with the rotating member so that the accumulated ink may not reach above a predetermined height.

Japanese Laid-Open Patent Publication No. 2002-225313 (D2) discloses an inkjet recording apparatus that has a pigment disposal outlet and a dye disposal outlet arranged close to each other to cause the two types of disposal liquid to be mixed so that solidified pigment may be dissolved or the pigment disposal liquid may be prevented from solidifying.

Japanese Laid-Open Patent Publication No. 2006-031006 (D3) discloses a disposal toner collecting apparatus that includes a cleaning blade that scrapes and separates disposal toner remaining on the peripheral surface of a photoconductive medium, a disposal toner container that accommodates the disposal toner, a disposal toner path for carrying the separated disposal toner from the photoconductive medium to the disposal toner container, and a mixing blade that moves back and forth within the disposal toner path to prevent stagnation of the disposal toner.

Japanese Laid-Open Patent Publication No. 2005-144940 (D4) discloses the use of a sliding member that has plural sliding plates connected by connection ribs for removing disposal liquid that is accumulated at a sloped portion of an idle discharge liquid receiver onto which portion recording liquid is discharged, the sliding member being arranged to move back and forth in parallel directions with respect to the sloped surface portion without coming into contact with the sloped portion so that disposal liquid may be prevented from accumulating and growing at the sloped portion.

However, it is noted that the technique disclosed in D1 has a drawback in that ink may adhere to the rotating member that is used for scraping off the accumulated ink so that the space between the portion for receiving disposal liquid (ink) and the rotating member may gradually be reduced to prevent the accumulated ink from being effectively removed by the rotating member. Also, the technique disclosed in D2 has a drawback in that the pigment components cannot be completely dissolved so that accumulation of ink cannot be completely prevented. Also, it is noted that the technique disclosed in D3 is directed to mixing toner. Accordingly, toner may not adhere to the mixing plate, but in the case where ink is used, the ink may adhere to the mixing plate and cause malfunction of the mixing plate. Also, the technique disclosed in D4 has a drawback in that ink may adhere to the sliding member to enter the gaps created within the sliding member mechanism so that the sliding member may be prevented from operating properly when the ink solidifies within the gaps.

BRIEF SUMMARY

In an aspect of this disclosure, there is provided a reliable inkjet recording apparatus that is capable of effectively preventing ink from accumulating unevenly in a disposal liquid tank and preventing ink from adhering to a mixing member.

In another aspect, an inkjet recording apparatus is provided that includes a disposal liquid tank that accommodates disposal ink discharged from the inkjet recording head for purposes other than recording, a mixing member that mixes the disposal ink accumulated in the disposal liquid tank, and a cleaning unit that cleans the mixing member.

In another aspect, the mixing member that mixes the disposal ink accumulated in the disposal liquid tank is provided to enable disposal ink accumulated at one location to be dispersed throughout the disposal liquid tank so that the disposal liquid tank may be efficiently used, for example. In another aspect of the present embodiment, since solidified ink adhered to the mixing member may cause malfunction of the apparatus, and in a case where ribs are provided, the ribs may be rounded by the disposal ink to hinder efficient mixing performance by the mixing member, the cleaning unit is provided to prevent the disposal ink from adhering to the mixing member so that reliability and efficiency of the mixing member may be improved, for example.

DESCRIPTION OF THE PREFERRED EMBODIMENTS

In the following, preferred embodiments of the present invention are described with reference to the accompanying drawings.

Figure 1A:
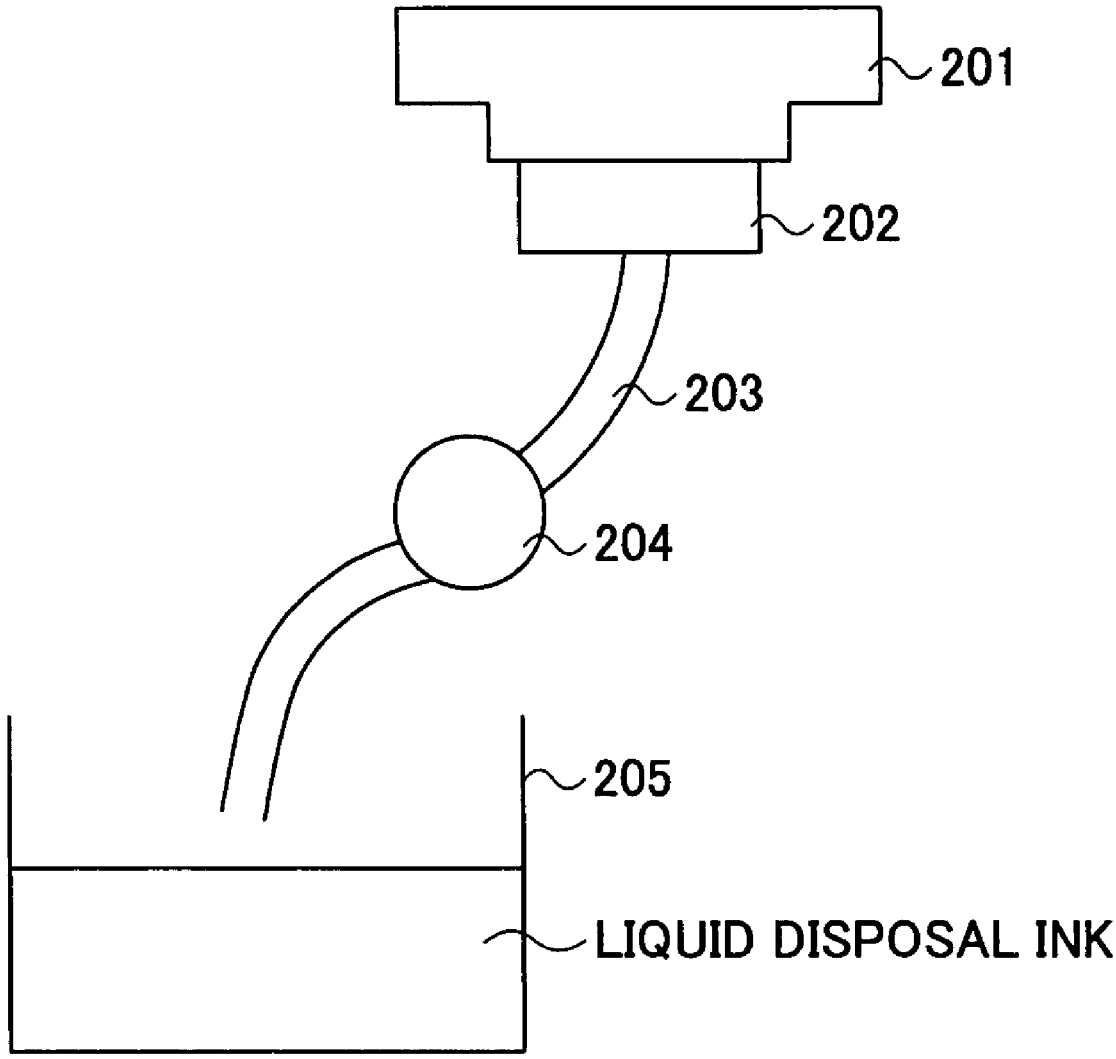
FIGS. 1A and 1B are cross-sectional views of a maintenance/restoration device of an inkjet recording apparatus.
Figure 1B:
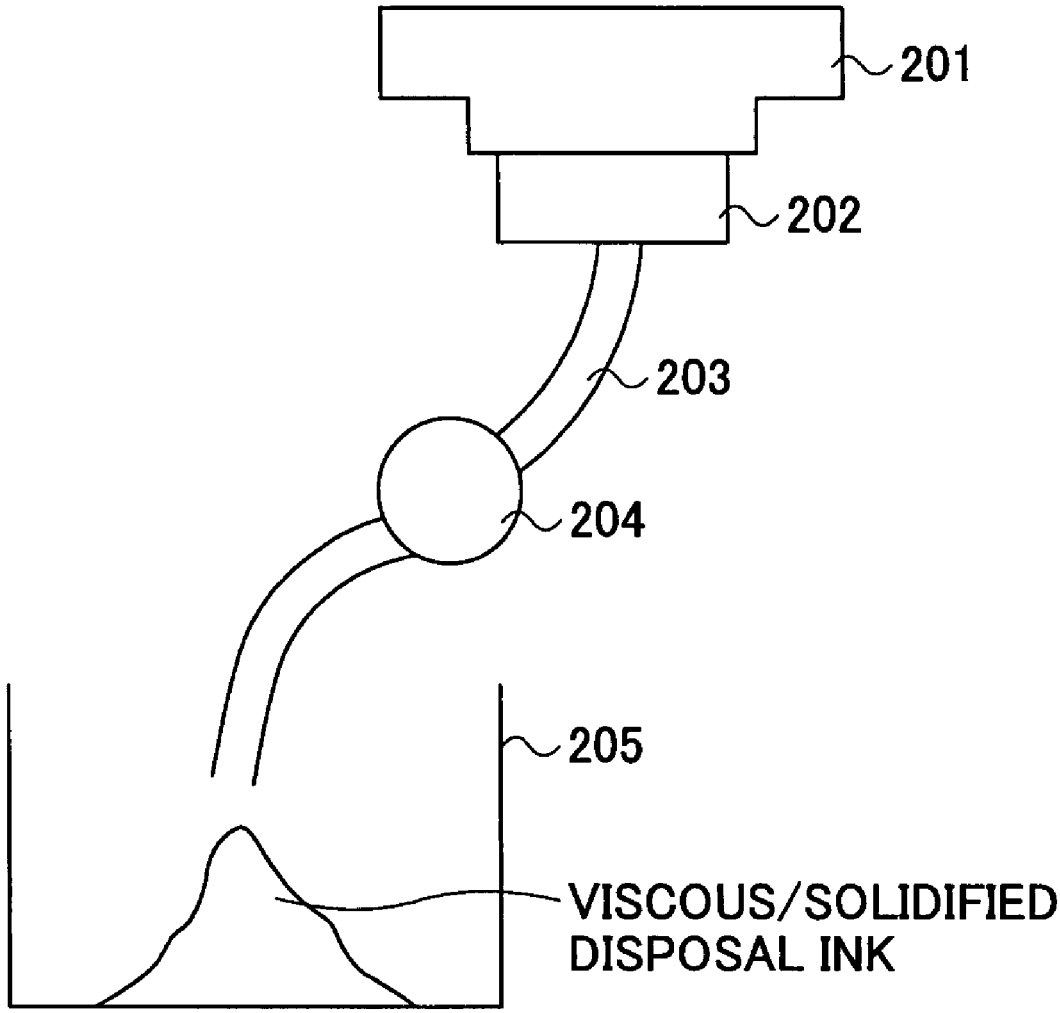
Figure 2:
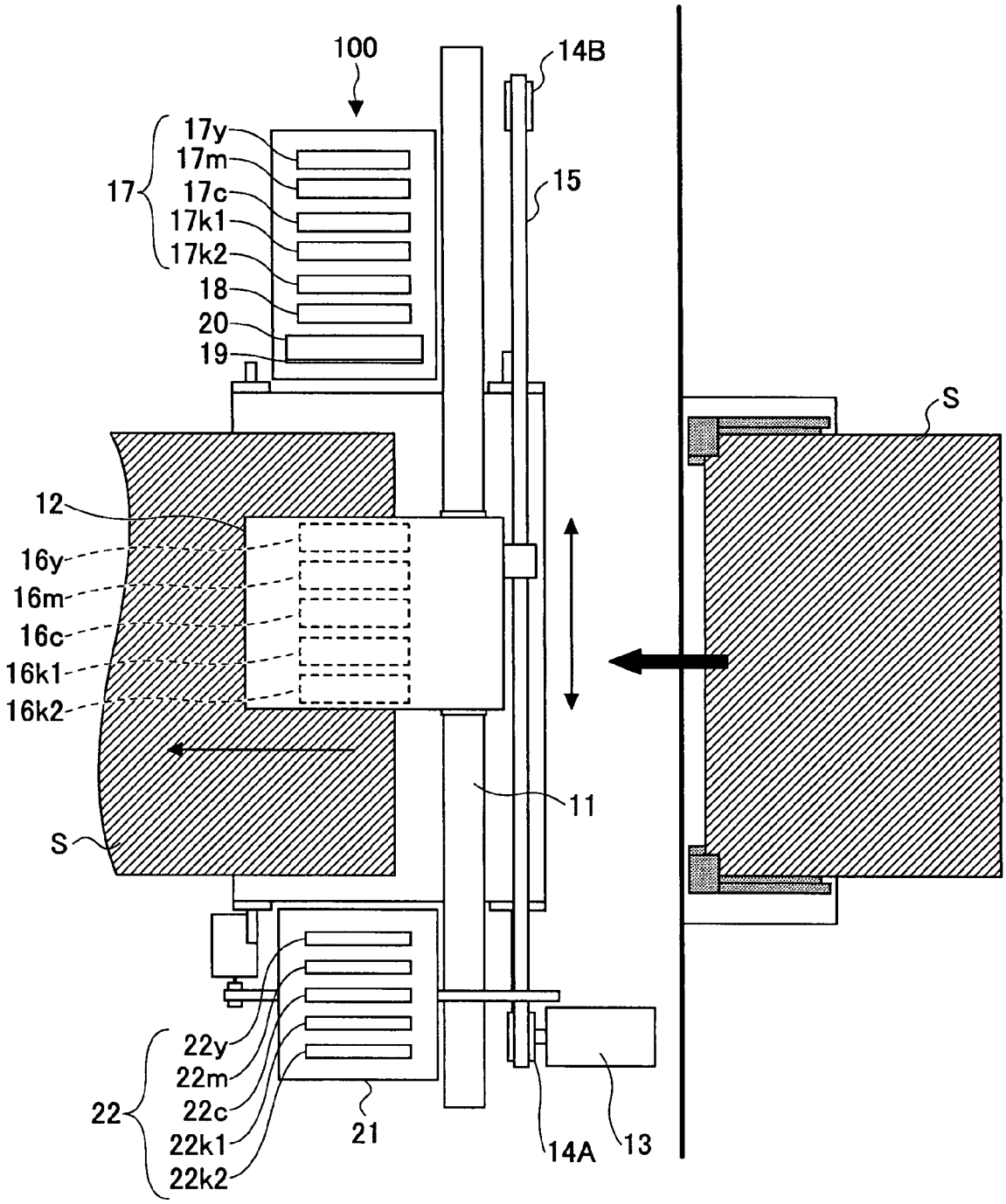
FIG. 2 is a plan view of an image forming unit of an inkjet recording apparatus according to an embodiment of the present invention.

FIG. 1 is a plan view of an image forming unit of an inkjet recording apparatus according to an embodiment of the present invention that includes a maintenance/restoration device. The illustrated image forming unit has a carriage 12 that is supported by a guide rod 11 and a guide stay (not shown), and a main scanning motor 13 that moves the carriage 12 in a main scanning direction via a timing belt 15 that is arranged around a drive pulley 14A and a driven pulley 14B.

Also, the illustrated image forming unit has an inkjet recording head 16 arranged on the carriage 12 for discharging liquid droplets in different colors. It is noted that the illustrated image forming unit is a so-called shuttle-type image forming unit that is configured to form an image by discharging liquid droplets from the inkjet recording head 16 while moving the carriage 12 in the main scanning direction and moving a paper sheet S in a sheet conveying direction (sub scanning direction). However, other embodiments are possible such as that using a line type recording head.

In the illustrated example, the inkjet recording head 16 includes a total of five liquid droplet discharge heads. Specifically, the inkjet recording head 16 includes two liquid droplet discharge heads 16*k*1 and 16*k*2 for discharging black (Bk) ink, and three liquid droplet discharge heads 16*c*, 16*m*, and 16*y* for discharging cyan (C) ink, magenta (M) ink, and yellow (Y) ink, respectively. It is noted that corresponding color inks are supplied to the liquid droplet discharge heads 16*k*1, 16*k*2, 16*c*, 16*m*, and 16*y* from sub tanks (not shown) that are loaded in the carriage 12.

It is noted that the inkjet recording head 16 may be a so-called piezo head that uses a piezoelectric element as pressure generating means (actuator means) for pressurizing ink within an ink flow path (pressure generating chamber) to deform a vibrating plate forming a wall of the ink flow path and change the internal shape (volume) of the ink flow path so that ink droplets may be discharged, for example. Also, the inkjet recording head 16 may be a so-called thermal head that uses a thermal resistor to heat the ink within the ink flow path and induce generation of air bubbles so that ink droplets may be discharged by the resulting pressure from such air bubble generation, for example. Further, the inkjet recording head 16 may be a so-called electrostatic head that has an electrode and a vibrating plate forming a wall of the ink flow path facing each other to cause the vibrating plate to be deformed by an electrostatic force that is generated between the vibrating plate and the electrode so that the internal shape (volume) of the ink flow path may be changed and ink droplets may be discharged, for example.

A maintenance/restoration device 100 according to an embodiment of the present invention for maintaining or restoring stable ink discharge characteristics of the nozzles of the inkjet recording head 16 is arranged at a non-printing region on one side of the carriage scanning direction. The maintenance/restoration device 100 includes a suction pump (not shown), five moisture retention caps 17*k*2, 17*k*1, 17*c*, 17*m*, and 17*y* (collectively referred to as moisture retention caps 17 hereinafter) for capping the nozzle surfaces of the liquid droplet discharge heads of the inkjet recording head 16, a suction cap 18, a wiper blade 19 for wiping the nozzle surfaces of the inkjet recording head 16, and an idle discharge receiving member 20 for performing liquid discharge operations that are unrelated to recording operations (idle discharge operations), for example.

Also, an idle discharge receiving member 21 for discharging liquid droplets unrelated to recording from the discharge heads of the inkjet recording head 16 (idle discharge operations) is arranged at a non-printing region at the other side of the carriage scanning direction. The idle discharge receiving member 21 includes five openings 22*k*2, 22*k*1, 22*c*, 22*m*, and 22*y* (collectively referred to as openings 22 hereinafter) corresponding to the discharge heads of the inkjet recording head 16.

Figure 3:
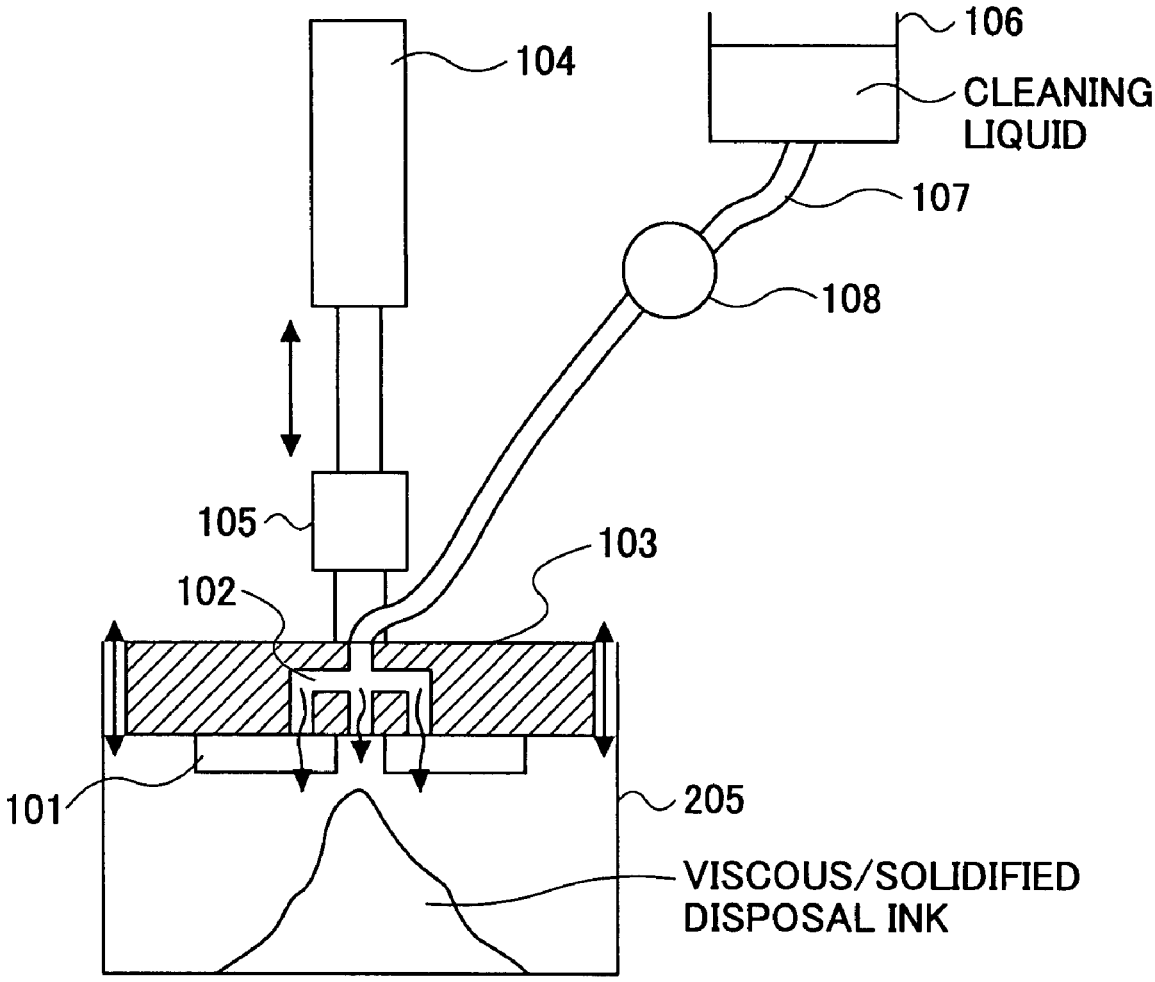
FIG. 3 is a cross-sectional view of a maintenance/restoration device according to a first embodiment of the present invention.
Figure 4:
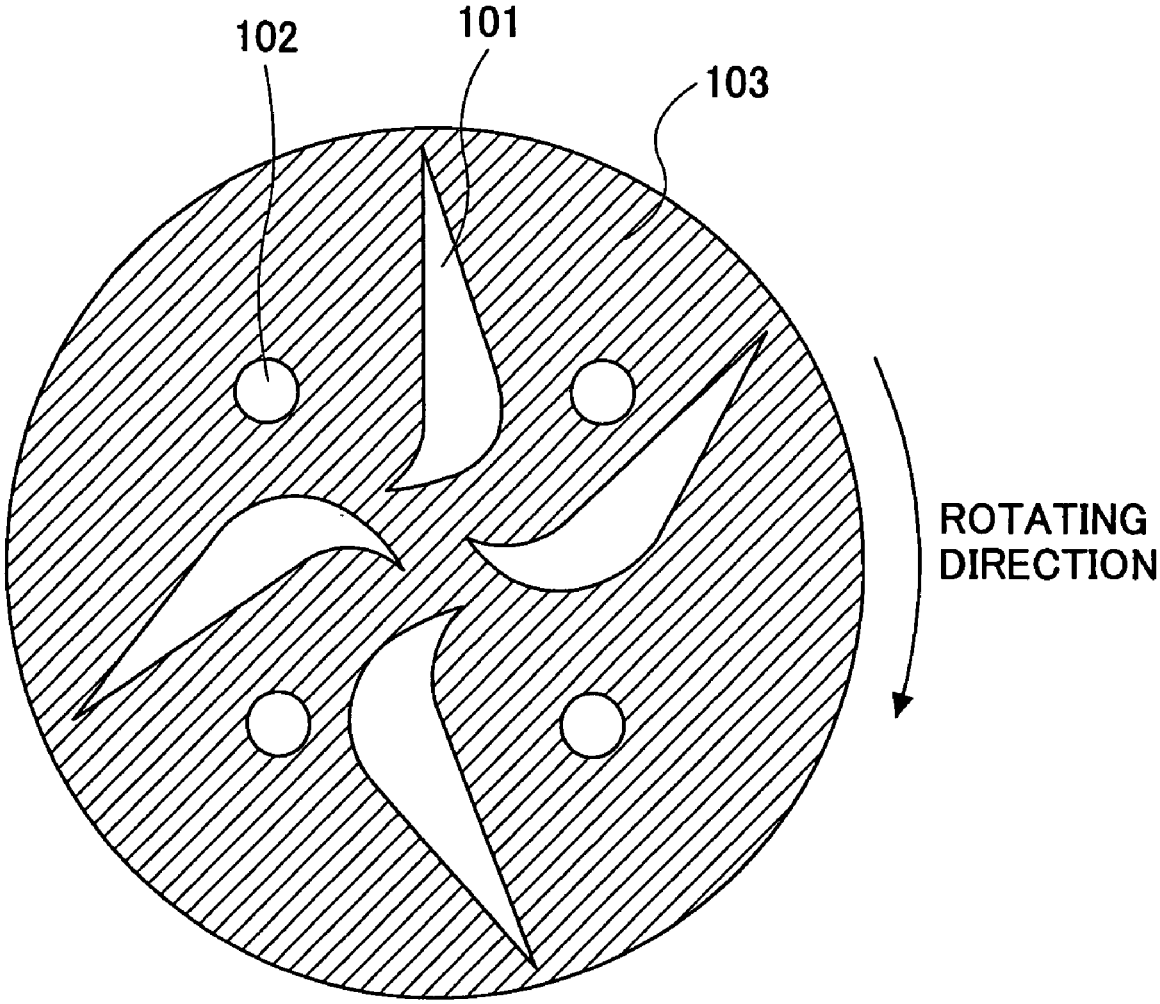
FIG. 4 is a plan view of a rib of a mixing member of the maintenance/restoration device shown in FIG. 3.

FIG. 3 is a cross-sectional view of a maintenance/restoration device according to a first embodiment of the present invention. It is noted that in FIG. 3, components that are identical to those shown in FIG. 1 are given the same numerical references. The illustrated maintenance/restoration device includes a mixing member 103 that has ribs 101 for mixing ink accumulated in a disposal liquid tank 205 and dispersion outlets 102 for dispersing liquid droplets to the ribs 101; a solenoid 104 that raises and lowers the mixing member 103; and a motor 105 that rotates the mixing member 103. In the present embodiment, when the motor 105 is rotated, cleaning liquid accommodated in a cleaning liquid tank 106 is supplied to the dispersion outlets 102 of the mixing member 103 via a supply tube 107 and a supply pump 108 so that the cleaning liquid may be dispersed from the dispersion outlets 102 in a rotating direction in response to the rotation of the mixing member 103 to be scattered toward the ribs 101 of the mixing member 103. In this way, ink may be prevented from adhering to the ribs 101 of the mixing member 103. In a preferred embodiment, water repellent such as silicon coating or Ni-PTFE eutectoid plating may be applied to the mixing member 103. Also, the ribs 101 of the mixing member 103 may extend in the rotational axis direction of the mixing member 103 to mix the ink accumulated in the disposal liquid tank 205 upon being rotated. Also, it is noted that the cleaning liquid may be water or alcohol, for example.

In the following, operations of the above-described maintenance/restoration device according to the present embodiment are described. When viscous ink is accumulated in the disposal liquid tank 205, the solenoid 104 is driven based on a drive signal from a control circuit (not shown), and the mixing member 103 is lowered until it reaches the accumulated viscous ink. When the mixing member 103 is lowered to a predetermined position to reach the accumulated viscous ink, the motor 105 is driven based on a drive signal from the control circuit (not shown) to thereby rotate the mixing member 103. In turn, the accumulated viscous ink is mixed by the ribs 101 of the mixing member 103. At the same time, the pump 108 is driven based on a drive signal from the control circuit so that the cleaning liquid stored in the cleaning liquid tank 106 may be supplied to the dispersion outlets 102 of the mixing member 103 via the supply tube 107. In turn, the cleaning liquid is dispersed from the dispersion outlets 102 toward the ribs 101 of the mixing member 103 to wash out the ink adhered to the ribs 101. In this way, the maintenance/restoration device according to the present embodiment may prevent ink from accumulating within the disposal liquid tank and also prevent the ink from adhering to the mixing member.

Figure 5:
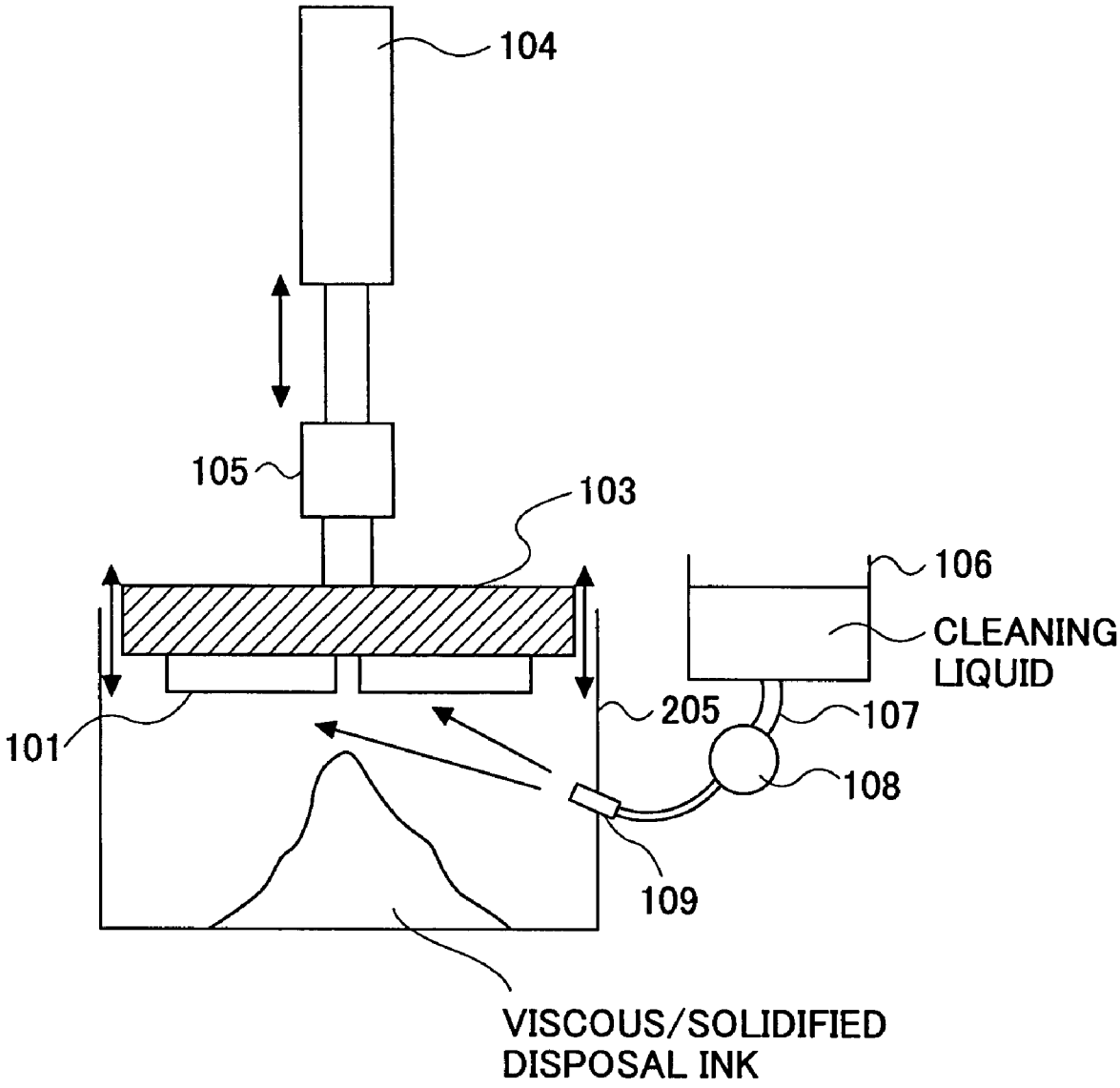
FIG. 5 is a cross-sectional view of a maintenance/restoration device according to a second embodiment of the present invention.
Figure 6:
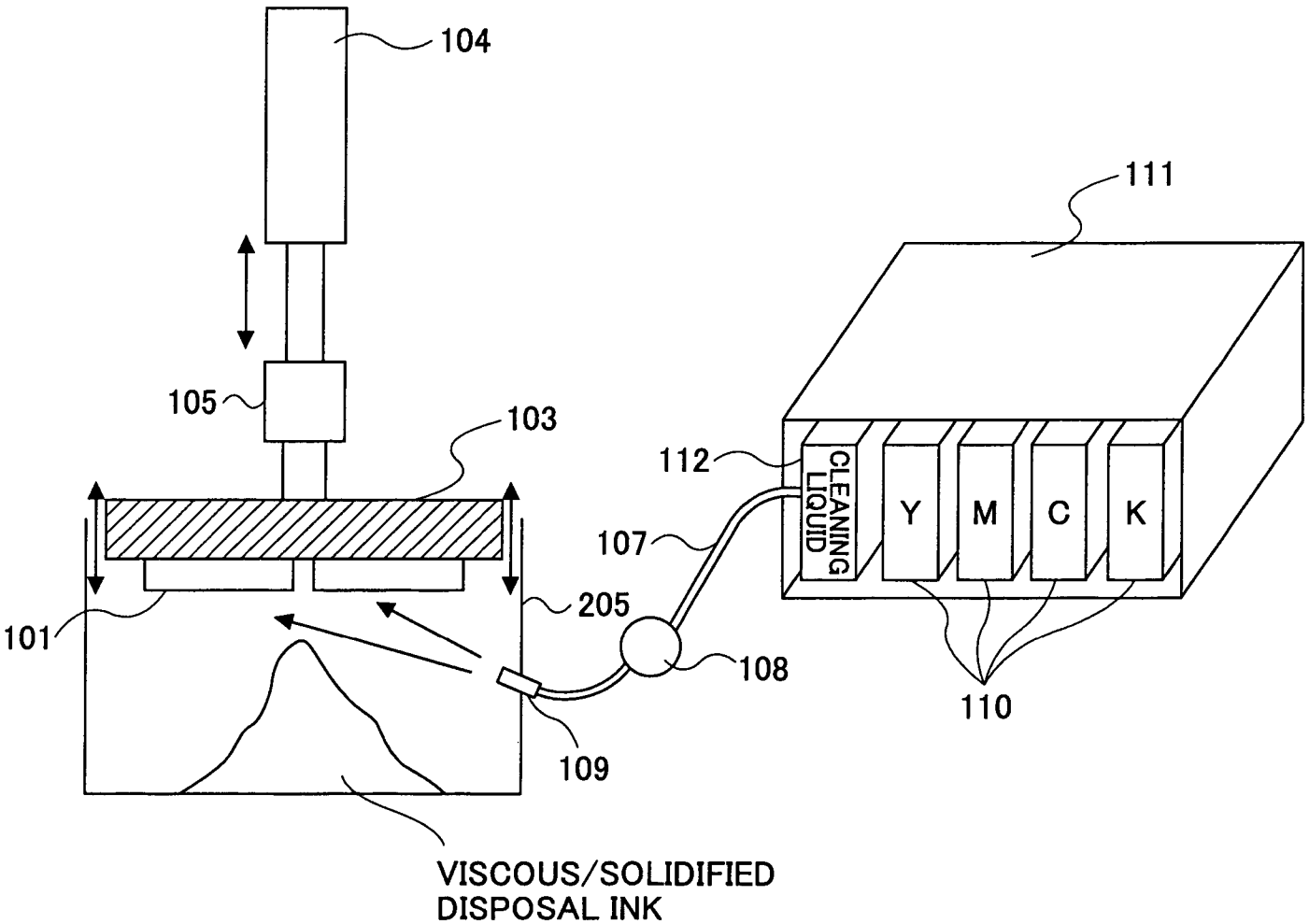
FIG. 6 is a cross-sectional view of a maintenance/restoration device modified from the second embodiment of the present invention.

FIG. 5 is a cross-sectional view of a maintenance/restoration device according to a second embodiment of the present invention. It is noted that in this drawing, components that are identical to those shown in FIG. 3 are given the same reference numerals. The illustrated maintenance/restoration device is configured to pump cleaning liquid from a cleaning liquid tank 106 based on a drive signal from a control circuit (not shown) and spray the cleaning liquid via a spray nozzle 109 that is attached to a part of the disposal liquid tank 205 to clean (wash) the ribs 101 of the mixing member 103. In another embodiment as is shown in FIG. 6, an exchangeable cleaning liquid cartridge 112 containing cleaning liquid to be sprayed on the mixing member 103 may be accommodated in a cartridge case 111 that accommodates ink cartridges 110 containing inks used for image formation, and the cleaning liquid may be pumped by the pump 108 from the cleaning liquid cartridge 112 to spray the cleaning liquid on the mixing member 103 via the spray nozzle 109 arranged at a part of the disposal liquid tank 205.

Figure 7A:
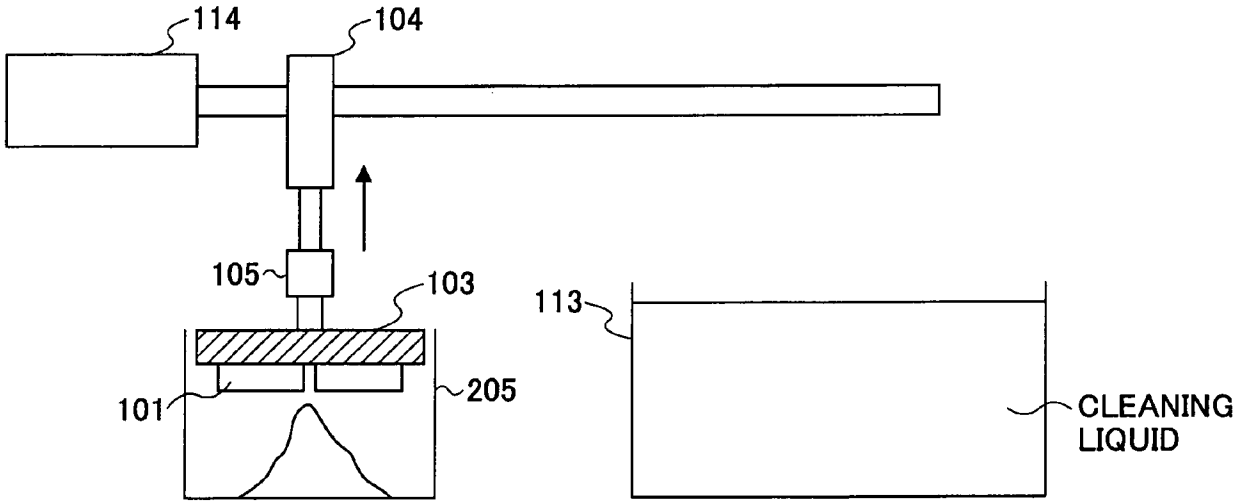
FIGS. 7A-7C are cross-sectional views of a maintenance/restoration device according to a third embodiment of the present invention.
Figure 7B:
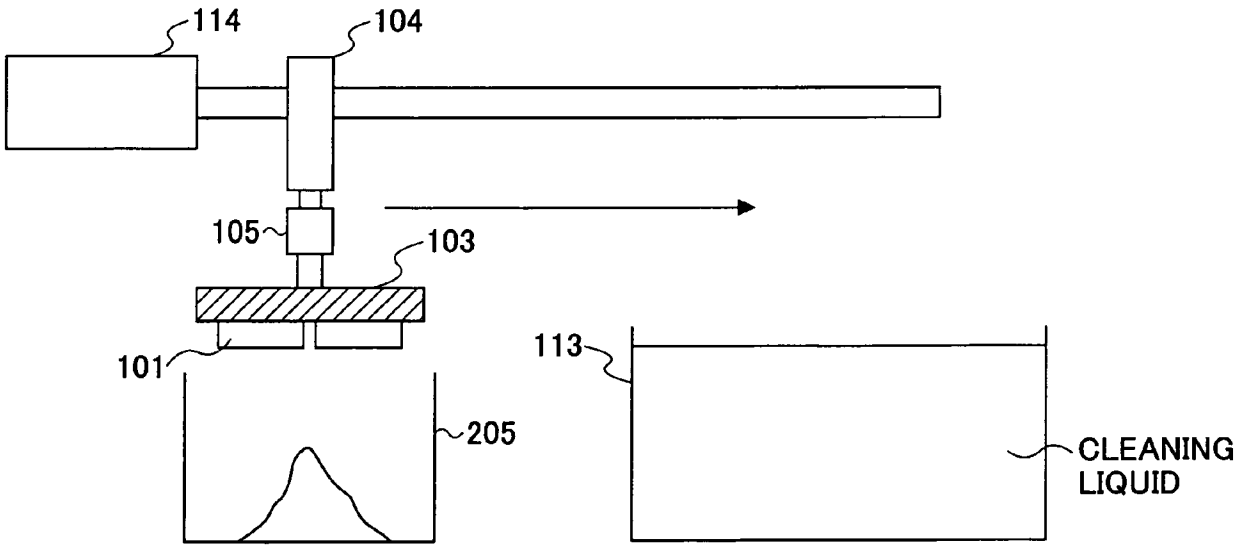
Figure 7C:
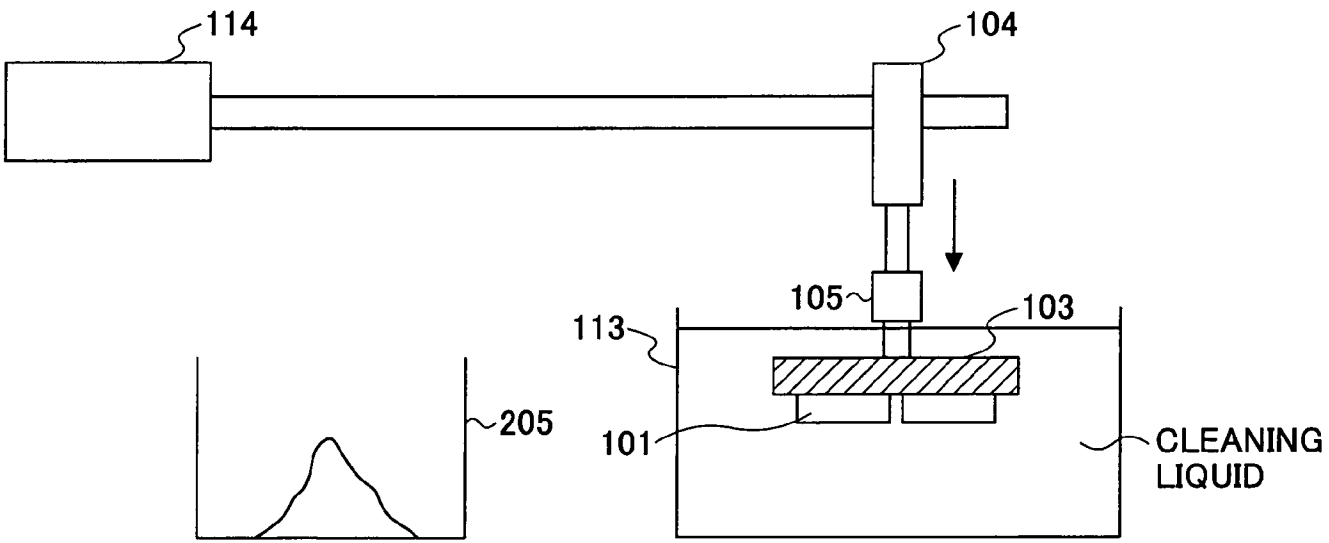

FIGS. 7A-7C are cross-sectional views of a maintenance/restoration device according to a third embodiment of the present invention. It is noted that in this drawing, components that are identical to those shown in FIG. 3 are given the same reference numerals. The illustrated maintenance/restoration device according to the present embodiment includes a wash tank 113 for accommodating and washing the mixing member 103 in its entirety and a solenoid 104 for moving the mixing member 103 into the wash tank 113.

As is shown in FIGS. 8A and 8B, the solenoid 104 is driven based on a drive signal from a control circuit (not shown) to move the maintenance/restoration device upward from the disposal liquid tank 205 and then sideways to a position above the wash tank 113 that is arranged next to the disposal liquid tank 205. Then, as is shown in FIG. 8C, the solenoid 104 is driven based on a drive signal from the control circuit to lower the mixing member 103 into the cleaning liquid contained in the wash tank 113. Then, the motor 105 is driven based on a drive signal from the control circuit to rotate the mixing member 103 so that it may be washed as a whole.

Figure 8:
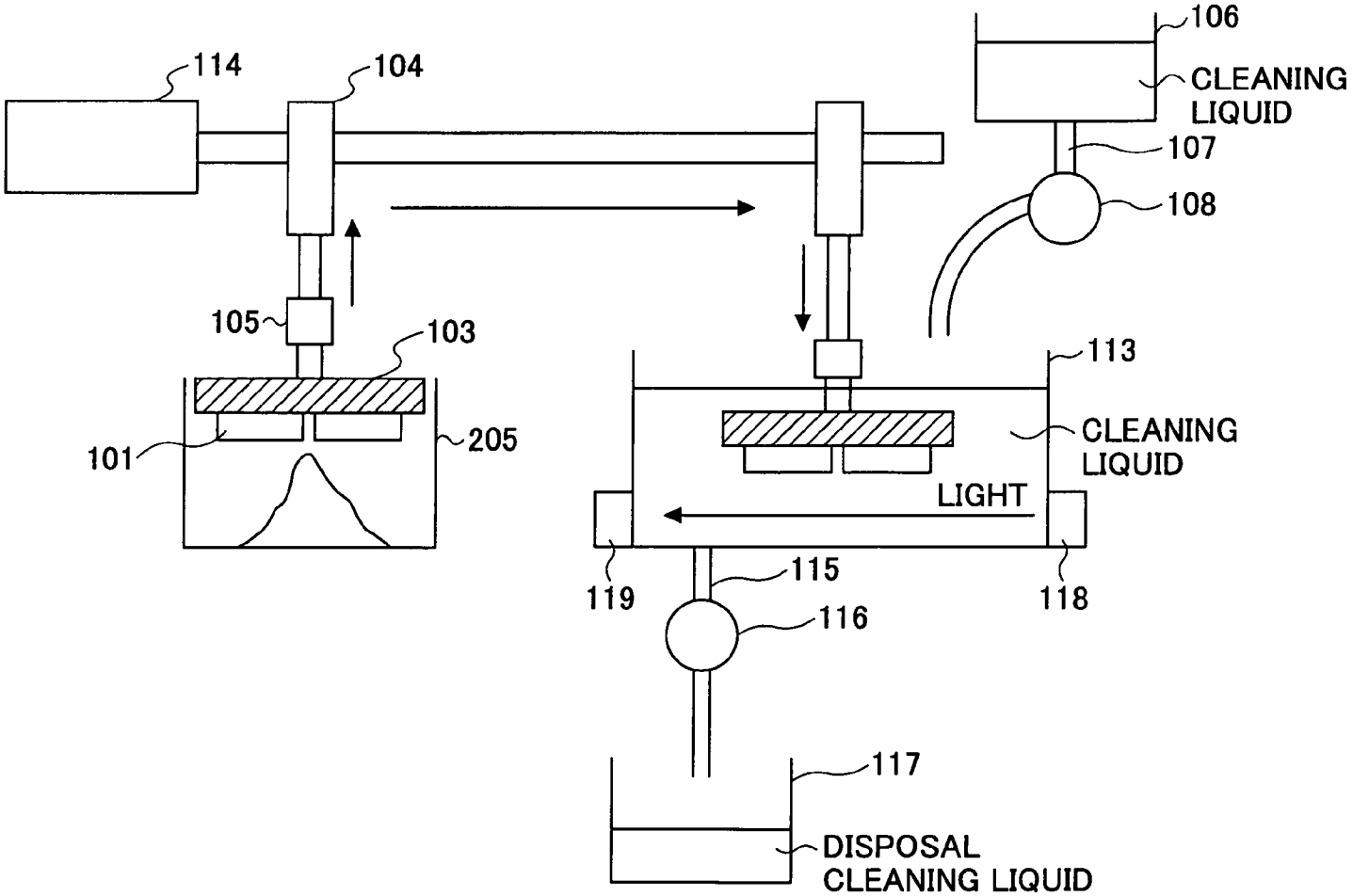
FIG. 8 is a cross-sectional view of a maintenance/restoration device modified from the third embodiment of the present invention.

In one preferred embodiment as is shown in FIG. 8, the cleaning liquid contained in the wash tank 113 may be exchanged. Specifically, the wash tank 113 is connected to a cleaning liquid tank 106 containing unused cleaning liquid via a supply tube 107 and a supply pump 108. The wash tank 113 is also connected to a disposal cleaning liquid tank 117 containing used cleaning liquid via a disposal liquid tube 115 and a disposal liquid supply pump 116. Also, a transparent sensor including a light emitting element 118 and a light receiving element 119 is arranged at the wash tank 113 for detecting the contamination level of the cleaning liquid contained in the wash tank 113. The cleaning liquid contained in the wash tank 113 is exchanged based on contamination detection information from the transparent sensor made up of the light emitting element 118 and the light receiving element 119. In this case, the disposal liquid supply pump 116 is driven based on a drive signal from the control circuit to discharge the contaminated cleaning liquid out of the wash tank 113. When the wash tank 113 becomes empty, operations of the disposal liquid supply pump 116 are stopped. Then, the supply pump 108 is driven based on a drive signal from the control circuit to supply the unused cleaning liquid contained in the cleaning liquid tank 106 into the wash tank 113.

Figure 9:
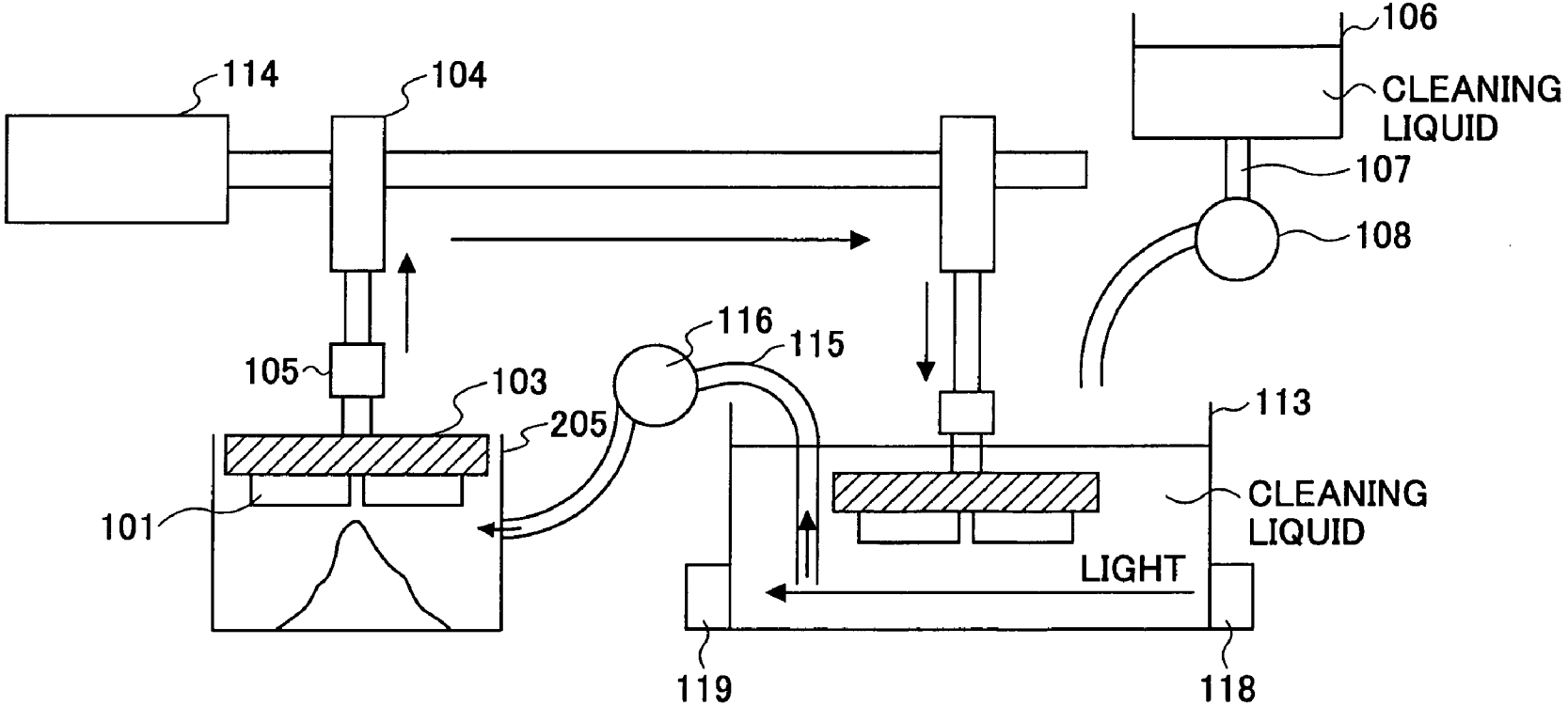
FIG. 9 is a cross-sectional view of another maintenance/restoration device modified from the third embodiment of the present invention.
Figure 10:
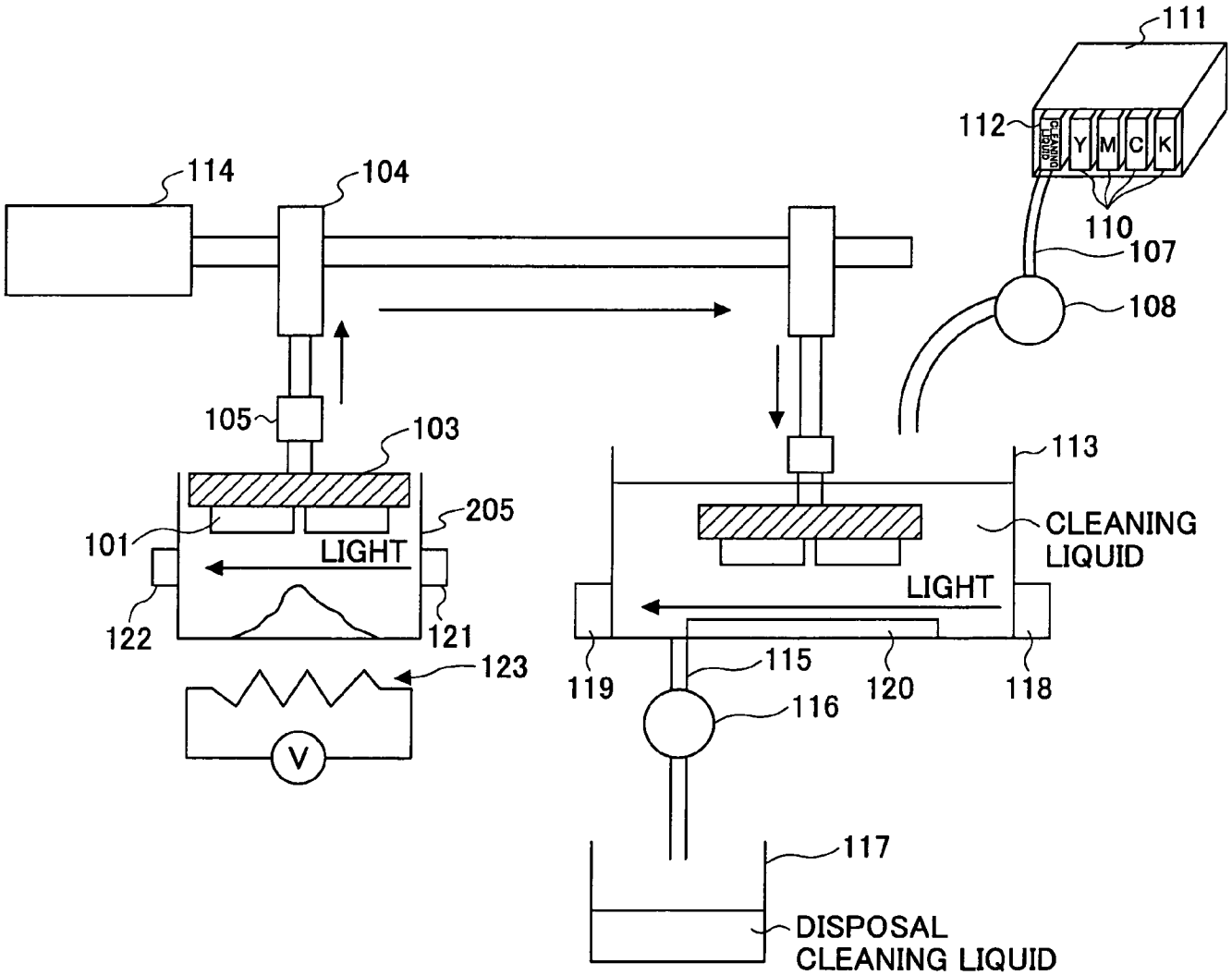
FIG. 10 is a cross-sectional view of another maintenance/restoration device modified from the third embodiment of the present invention.

In one embodiment, the timing for exchanging the cleaning liquid contained in the wash tank 113 may be determined by counting the number of times the mixing member 103 has been washed in the wash tank 113, and the cleaning liquid may be exchanged when the count number reaches a predetermined number. In another embodiment as is shown in FIG. 9, the wash tank 113 and the disposal liquid tank 205 may be interconnected via the supply tube 115 and the disposal liquid supply pump 116, and in the case of exchanging the cleaning liquid contained in the wash tank 113, the disposal liquid supply pump 116 may be driven to discharge the disposal cleaning liquid into the disposal liquid tank 205. In another embodiment as is shown in FIG. 10, an exchangeable cleaning liquid cartridge 112 may be accommodated in a cartridge case 111 that accommodates ink cartridges 110 containing inks for enabling image formation, the exchangeable cleaning liquid cartridge 112 containing the cleaning liquid used in the wash tank 113 for washing the mixing member 103. In this embodiment, the supply pump 108 may be driven to supply the cleaning liquid contained in the cleaning liquid cartridge 112 to the wash tank 113. In another aspect of the present embodiment, a supersonic wave oscillator 120 may be arranged inside the wash tank 113, and the cleaning liquid contained in the cleaning liquid tank 113 may be oscillated by supersonic wave in order to improve cleaning efficiency for cleaning the mixing member 103. In another aspect of the present embodiment, a transparent sensor made up of a light emitting element 121 and a light receiving element 122 may be used as accumulation amount detection means for detecting the amount of viscous ink accumulated inside the disposal liquid tank 205. In a further aspect of the present embodiment, a heater 123 may be arranged in the vicinity of the disposal liquid tank 205 (at the bottom side of the disposal liquid tank 205 in FIG. 10), and the cleaning liquid discharged into the disposal liquid tank 205 may be evaporated to enable efficient use of the disposal liquid tank 205.

In the following, exemplary advantages realized by preferred embodiments of the present invention are described.

An inkjet recording apparatus according to an embodiment of the present invention includes a mixing member that mixes the disposal ink accumulated in a disposal liquid tank and a cleaning unit that cleans the mixing member. According to an aspect of the present invention, disposal ink may be prevented from unevenly accumulating within the disposal liquid tank and ink may be prevented from adhering to the mixing member so that reliability of the inkjet recording apparatus may be improved, for example.

In one preferred embodiment, the mixing member may be configured to rotate and include a rib that extends in a rotational axis direction so that the accumulated disposal ink may be dispersed throughout the disposal liquid tank to enable efficient use of the disposal liquid tank, for example.

In another preferred embodiment, a water repellent finish may be applied to the mixing member in order to prevent ink from adhering to the mixing member and improve reliability and efficiency of the mixing member, for example.

In another preferred embodiment, the inkjet recording apparatus may include a disposal ink accumulation amount detecting unit that detects the amount of disposal ink accumulated in the disposal liquid tank, and the mixing member may be configured to mix the accumulated disposal ink when the accumulation amount detected by the disposal ink accumulation amount detecting unit reaches a predetermined amount. It is noted that power may be wasted by frequently mixing the accumulated disposal ink even when the amount of disposal ink accumulated in the disposal liquid tank is relatively small; thus, energy may be conserved by having the mixing member mix the accumulated disposal ink only when the disposal ink accumulation amount reaches a predetermined accumulation amount, for example.

In another preferred embodiment, the inkjet recording apparatus may include a heater that heats the disposal liquid tank so that cleaning liquid discharged into the disposal liquid tank may be evaporated to enable efficient use of the disposal liquid tank, for example.

In another preferred embodiment, the cleaning unit may include a spray nozzle that sprays cleaning liquid onto the mixing member in order to prevent ink from adhering to the mixing member and improve efficiency and reliability of the mixing member, for example.

In another preferred embodiment, the cleaning liquid may be accommodated in an exchangeable cleaning liquid cartridge so that the cleaning liquid cartridge may be easily replaced by a new cartridge when the cleaning liquid contained therein is used up, for example.

In another preferred embodiment, the cleaning unit may include a wash tank that accommodates cleaning liquid and immerses the mixing member in the cleaning liquid to wash the mixing member as a whole. In this way, the entire mixing unit may be cleaned and ink may be prevented from adhering to the mixing member so that reliability and efficiency of the mixing member may be improved, for example.

In another preferred embodiment, the number of times mixing operations are performed for mixing the accumulated disposal ink in the disposal liquid tank using the mixing member is counted, and the cleaning unit may be configured to wash the mixing unit as a whole in the wash tank when the number of times the mixing operations are performed reaches a predetermined number. It is noted that when the mixing member is washed frequently, although reliable performance of the mixing member may be ensured, power may be needlessly wasted. On the other hand, when the number of times the mixing member is washed is reduced, ink adhered to the mixing member may not be completely removed during washing operations. Accordingly, in the present embodiment, test data on the relationship between the number mixing operations performed and the washing efficiency are obtained beforehand, and a predetermined number of times mixing operations may be performed between washing operations while ensuring washing efficiency is determined beforehand based on the test data. By washing the mixing member when the number of times mixing operations are performed reaches the predetermined number, washing efficiency may be ensured with little power, for example.

In another preferred embodiment, the cleaning liquid contained in the wash tank may be exchanged so that cleaning liquid contained in the wash tank may be replaced when it is contaminated through use. In this way, washing performance may be maintained, and reliability and efficiency of the mixing member may be improved, for example.

In another preferred embodiment, the inkjet recording apparatus may include a cleaning liquid contamination level detecting unit that detects a contamination level of the cleaning liquid contained in the wash tank, and the cleaning liquid may be exchanged when the contamination level detected by the cleaning liquid contamination level detecting unit reaches a predetermined level. In this way, the contamination level of the cleaning liquid contained in the wash tank may be detected, and the cleaning liquid may be replaced when the level of contamination is high so that washing performance may be ensured, and reliability and efficiency of the mixing member may be improved, for example.

In another preferred embodiment, the number of times washing operations are performed for washing the mixing member in the wash tank may be counted, and the cleaning liquid contained in the wash tank may be exchanged when the number of times the washing operations are performed in the wash tank reaches a predetermined number. It is noted that when the number of times washing operations are performed is increased, the cleaning liquid contained in the wash tank may be contaminated so that washing efficiency is decreased. Accordingly, in the present embodiment, test data on the relationship between the number of washing operations and the washing efficiency are obtained beforehand, and a predetermined number times of washing operations may be adequately performed between cleaning liquid exchange operations is determined based on the obtained test data. In the present embodiment that involves counting the number of washing operations and exchanging the cleaning liquid when the count number reaches a predetermined number, detection means such as a sensor for detecting the contamination level of the cleaning liquid contained in the wash tank does not have to be used so that the apparatus configuration may be simplified and manufacturing costs may be reduced, for example.

In another preferred embodiment, disposal cleaning liquid to be discharged from the wash tank may be supplied to the disposal liquid tank that accommodates the accumulated disposal ink so that a dedicated disposal cleaning liquid tank does not have to be provided and the apparatus configuration may be simplified, for example.

In another preferred embodiment, the cleaning liquid may be accommodated in an exchangeable cleaning liquid cartridge so that the cleaning liquid cartridge may be easily replaced by a new cartridge when the cleaning liquid contained therein is used up, for example.

In another embodiment, the inkjet recording apparatus may include a supersonic wave oscillator that oscillates the cleaning liquid contained in the wash tank with supersonic wave so that the mixing member may be cleaned with greater accuracy, for example.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-229971 filed on Aug. 28, 2006, the entire contents of which are hereby incorporated by reference.

What is claimed is:

1. An inkjet recording apparatus that records an image by discharging ink from an inkjet recording head, said inkjet recording apparatus comprising:

a disposal liquid tank that accommodates disposal ink that is discharged from the inkjet recording head for purposes other than recording, the disposal ink being viscous or solidified and unevenly accumulating in a heap, in at least some instances;

an ink dispersing member that disperses the unevenly accumulated disposal ink heap throughout the disposal liquid tank, said ink dispersing member having a plate-like surface facing the disposal ink heap, plural ribs formed on said plate-like surface to protrude from the plate-like surface toward the disposal ink heap, and dispersion outlets to spray cleaning liquid to the ribs, said ink dispersing member rotating around an axis of revolution, said plate-like surface being normal to the axis of revolution, said ribs being disposed symmetrically with respect to the axis of revolution and being configured and disposed to extend generally in a radial direction, and a combination of the cleaning liquid sprayed on the ribs and the rotation of the ink dispersing member around the axis of revolution reducing adherence of ink to the ribs;

a cleaning unit that cleans the ink dispersing member; and a moving member that lowers the ink dispersing member to a first position to reach the disposal ink heap already accumulated in the disposal liquid tank and moves the ink dispersing member upward to a second position where the ink dispersing member does not reach the disposal ink and where the cleaning member cleans the ink dispersing member.

2. The inkjet recording apparatus as claimed in claim 1, wherein the ink dispersing member is configured to rotate and includes a rib that extends in a rotational axis direction.

3. The inkjet recording apparatus as claimed in claim 1, wherein a water repellent finish is applied to the ink dispersing member.

4. The inkjet recording apparatus as claimed in claim 1, further comprising:

a disposal ink accumulation amount detecting unit that detects an accumulation amount of disposal ink in the disposal liquid tank;

wherein the ink dispersing member is configured to disperse the accumulated disposal ink when the accumulation amount detected by the disposal ink accumulation amount detecting unit reaches a predetermined amount.

5. The inkjet recording apparatus as claimed in claim 1, further comprising:

a heater that heats the disposal liquid tank.

6. The inkjet recording apparatus as claimed in claim 1, wherein the cleaning unit includes a spray nozzle that sprays a cleaning liquid onto the ink dispersing member.

7. The inkjet recording apparatus as claimed in claim 6, wherein the cleaning liquid is accommodated in an exchangeable cleaning liquid cartridge.

8. The inkjet recording apparatus as claimed in claim 1, wherein the cleaning unit includes a wash tank that accommodates a cleaning liquid and immerses the ink dispersing member in the cleaning liquid to wash the ink dispersing member as a whole.

9. The inkjet recording apparatus as claimed in claim 8, wherein a number of times dispersing operations are performed for dispersing the accumulated disposal ink in the disposal liquid tank using the ink dispersing member is counted; and the cleaning unit is configured to wash the ink dispersing member as a whole in the wash tank when the number of times the dispersing operations are performed reaches a predetermined number.

10. The inkjet recording apparatus as claimed in claim 8, wherein the cleaning liquid contained in the wash tank is exchanged.

11. The inkjet recording apparatus as claimed in claim 10, further comprising:

a cleaning liquid contamination level detecting unit that detects a contamination level of the cleaning liquid contained in the wash tank;

wherein the cleaning liquid is exchanged when the contamination level detected by the cleaning liquid contamination level detecting unit reaches a predetermined level.

12. The inkjet recording apparatus as claimed in claim 10, wherein a number of times washing operations are performed for washing the ink dispersing member in the wash tank is counted; and the cleaning liquid contained in the wash tank is exchanged when the number of times the washing operations are performed in the wash tank reaches a predetermined number.

13. The inkjet recording apparatus as claimed in claim 8, wherein disposal cleaning liquid to be discharged from the wash tank is supplied to the disposal liquid tank that accommodates the accumulated disposal ink.

14. The inkjet recording apparatus as claimed in claim 8, wherein the cleaning liquid is accommodated in an exchangeable cleaning liquid cartridge.

15. The inkjet recording apparatus as claimed in claim 8, further comprising:

a supersonic wave oscillator that oscillates the cleaning liquid contained in the wash tank with supersonic wave.

16. The inkjet recording apparatus as claimed in claim 1, wherein when the moving member lowers the ink dispersing member to the first position, the plate-like surface of the ink dispersing member flattens the disposal ink heap.

* * * * *